US008585811B2

(12) United States Patent
Nye et al.

(10) Patent No.: US 8,585,811 B2
(45) Date of Patent: Nov. 19, 2013

(54) ELECTROLESS NICKEL ALLOY PLATING BATH AND PROCESS FOR DEPOSITING THEREOF

(75) Inventors: Aurora Marie Fojas Nye, Highland Park, NJ (US); Jerry G. Du, Princeton, NJ (US); Robert C. Andre, Glen Ridge, NJ (US)

(73) Assignee: OMG Electronic Chemicals, LLC, South Plainfield, NJ (US)

( * ) Notice: Subject to any disclaimer, the term of this patent is extended or adjusted under 35 U.S.C. 154(b) by 174 days.

(21) Appl. No.: 13/214,387

(22) Filed: Aug. 22, 2011

(65) Prior Publication Data

US 2012/0058259 A1 Mar. 8, 2012

Related U.S. Application Data

(60) Provisional application No. 61/379,835, filed on Sep. 3, 2010.

(51) Int. Cl.
*C23C 18/36* (2006.01)
*C23C 18/50* (2006.01)

(52) U.S. Cl.
USPC ..... 106/1.22; 106/1.27

(58) Field of Classification Search
USPC ..... 106/1.22, 1.27
See application file for complete search history.

(56) References Cited

U.S. PATENT DOCUMENTS 3,485,597 A 12/1969 Pearlstein
3,674,516 A * 7/1972 Kovac ..... 106/1.22
3,971,861 A * 7/1976 de Waltoff ..... 106/1.22
4,019,910 A 4/1977 Mallory, Jr.
4,029,541 A 6/1977 Barlow et al.
4,033,835 A 7/1977 Lerner et al.
4,167,416 A * 9/1979 Zolla ..... 106/1.27
4,244,739 A * 1/1981 Cagnassi ..... 106/1.11
4,269,625 A 5/1981 Molenaar
4,397,812 A 8/1983 Mallory, Jr.
5,258,061 A 11/1993 Martyak et al.
5,614,003 A * 3/1997 Mallory, Jr. ..... 106/1.22
6,020,021 A * 2/2000 Mallory, Jr. ..... 427/125
6,143,375 A 11/2000 Ross et al.
6,524,642 B1 * 2/2003 Leibman et al. ..... 427/443.1
6,645,557 B2 * 11/2003 Joshi ..... 427/443.1
6,720,499 B2 * 4/2004 Bokisa et al. ..... 174/257
6,800,121 B2 * 10/2004 Shahin ..... 106/1.22

(Continued)

FOREIGN PATENT DOCUMENTS

JP 2008-63644 A 3/2008

OTHER PUBLICATIONS

Kong, Shao, Wang, Liu, Chen; Electroless Sn-Ni alloy plating with high Sn content free of activation pretreatment; Journal of Alloys and Compounds; pp. 328-332; vol. 477, Nov. 2008.

(Continued)

*Primary Examiner* — Helene Klemanski
(74) *Attorney, Agent, or Firm* — Hahn, Loeser & Parks, LLP

(57) ABSTRACT

An aqueous nickel phosphorus tin alloy electroless plating bath and process for depositing a nickel phosphorus tin alloy onto a substrate, particularly an aluminum substrate for memory disk applications, wherein the nickel phosphorus tin alloy deposit provides enhanced thermal stability, as defined by the inhibition of crystallization and suppression of magnetization upon high temperature annealing when compared to typical NiP deposits.

10 Claims, 2 Drawing Sheets

(56) References Cited

U.S. PATENT DOCUMENTS

| | | | | |
|---|---|---|---|---|
| 6,902,765 | B2 * | 6/2005 | Brandes et al. | 427/305 |
| 7,407,720 | B2 | 8/2008 | Girt et al. | |
| 2005/0048328 | A1 | 3/2005 | Bian et al. | |
| 2006/0019122 | A1 | 1/2006 | Kawano et al. | |
| 2006/0222903 | A1 | 10/2006 | Ichihara et al. | |
| 2008/0206601 | A1 | 8/2008 | Mukai | |
| 2009/0040644 | A1 | 2/2009 | Lu et al. | |
| 2009/0130346 | A1 | 5/2009 | Osawa et al. | |
| 2009/0280357 | A1 | 11/2009 | Girt et al. | |
| 2012/0034492 | A1 | 2/2012 | Ruffini et al. | |

OTHER PUBLICATIONS

Zhang, Jiang, Li, Jiang, Lian; Electroless Ni-Sn-P coating on AZ91D magnesium alloy and its corrosion resistance; Surface & Coatings Technology; pp. 2570-2576; vol. 202, Sep. 2007.

Georgieva, Armyanov; Electroless deposition and some properties of Ni-Cu-P and Ni-Sn-P coatings; J Solid State Electrochem; pp. 869-876; vol. 11, Feb. 2007.

Balaraju, Jahan, Jain, Rajam; Structure and phase transformation behavior of electroless Ni-P. alloys containing tin and tungsten; Journal of Alloys and Compounds; pp. 319-327; vol. 436, Aug. 2006.

Georgieva, Kawashima, Armyanov, Valova, Hubin, Koyama, Steenhaut, Haydu, Delplancke, Tsacheva; Electroless Deposition of Ni-Sn-P and Ni-Sn-Cu-P Coatings; Journal of the Electrochemical Society; pp. C783-C788; vol. 152; No. 11, Oct. 2005.

Huber, Shabaker, Dumesic; Raney Ni-Sn Catalyst for H2 Production from Biomass-Derived Hydrocarbons; Science; Jun. 27, 2003; pp. 2075-2077; vol. 300.

Park, Lim, Kim, Kim; The effect of Sn addition on the glass-forming ability of Cu-Ti-Zr-Ni-Si metallic glass alloys; Journal of Non-Crystalline Solids; 2002; pp. 15-22; vol. 298.

Tachev, Georgieva, Armyanov; Magnetothermal study of nanocrystalline particle formation in amorphous electroless Ni-P and Ni-Me-P alloys; Electrochimica Acta; 2001; pp. 359-369; vol. 47.

Yi, Park, Kim; Ni-based bulk amorphous alloys in the Ni-Ti-Zr-(Si,Sn) system; Journal of Materials Research; Nov. 2000; pp. 2425-2430; vol. 15; No. 11.

Bangwei, Haowen; Effect of alloying elements on the amorphous formation and corrosion resistance of electroless Ni-P based alloys; Materials Science and Engineering; 2000; pp. 286-291; vol. A281.

Haowen, Bangwei, Qiaoqin; Preparation, Structure and Corrosion Properties of Electroless Amorphous Ni-Sn-P Alloys; Trans IMF; 1999; pp. 99-102; vol. 77; No. 3.

Armyanov, Steenhaut, Krasteva, Georgieva, Delplancke, Winand, Vereecken; Auger Electron Spectroscopy Element Profiles and Interface with Substrates of Electroless Deposited Ternary Alloys; Journal of the Electrochemical Society; Nov. 1996; pp. 3692-3698; vol. 143; No. 11.

Krasteva, Armyanov, Georgieva, Avramova; Thermal Stability of Electroless NiMeP Amorphous Alloys; Journal of Electronic Materials; 1995; pp. 941-946; vol. 24; No. 8.

Shimauchi, Ozawa, Tamura, Osaka; Preparation of Ni-Sn Alloys by an Electroless-Deposition Method; Journal of the Electrochemical Society; Jun. 1994; pp. 1471-1476; vol. 141; No. 6.

Mallory, Horhn; Electroless Deposition of Ternary Alloys; PlatingSurfFin; Apr. 1979; pp. 40-46.

Office Action on U.S. Appl. No. 12/849,783 (US Patent Application Publication No. 2012/0034492A1), 12 pages, Aug. 2010.

International Preliminary Report on Patentability for corresponding application PCT/US2011/048561, Mar. 2013.

Krasteva, Armyanov, Georgieva, Avramova, Fotty; Thermal Stability of Electroless NiMeP Amorphous Alloys; Defect Structure, Morphology and Properties of Deposits; A Publication of The Minerals, Metals & Materials Society; Edited by H. Merchant; 1995; pp. 259-272.

Gonzalez, White, Cocke; Autocatalytic Deposition of Ni-TM-P Alloys; Plating and Surface Finishing; Nov. 1990; pp. 63-67.

ISA/KR; PCT International Search Report and Written Opinion for PCT/US2011/048561; Feb. 24, 2012; 7 pages.

* cited by examiner

ELECTROLESS NICKEL ALLOY PLATING BATH AND PROCESS FOR DEPOSITING THEREOF

CROSS-REFERENCE TO RELATED APPLICATIONS

This patent application claims the benefit of U.S. Provisional Patent Application No. 61/379,835, filed Sep. 3, 2010, the disclosure of which is expressly incorporated by reference herein.

TECHNICAL FIELD

The invention relates to an aqueous nickel phosphorus tin alloy electroless plating bath and process for depositing this alloy layer onto substrates including, but not limited to, those for memory disk applications. In particular, this invention relates to an aqueous nickel phosphorus tin alloy memory disk electroless plating bath and the process for depositing this alloy onto a memory disk substrate, wherein the nickel phosphorus tin alloy provides a deposit with enhanced thermal stability as defined by the inhibition of crystallization and suppression of magnetization upon high temperature annealing.

BACKGROUND OF THE INVENTION

The electroless nickel plating industry has long been involved in developing metal coatings for various substrates. These coatings are deposited on materials, both metallic and non-metallic, imparting the desirable physical and chemical properties of a nickel alloy to the surface. This electroless plating method typically employs reducing agents, such as hypophosphite, and is described generally as a controlled autocatalytic chemical reduction process for depositing the desired metal as a deposit or plating on a suitable substrate. The deposit is formed upon immersion of an appropriate substrate into an aqueous nickel plating solution in the presence of a reducing agent and under appropriate electroless nickel plating conditions. The electroless nickel alloy formed on the surface of the substrate is often referred to as a coating, film, deposit, or plated layer.

In the computer industry, hard disk data storage elements, or memory disks, are generally made from aluminum or an aluminum alloy substrate. Through any variety of processes, the substrate is treated or otherwise coated so that it may act as a repository for magnetic media which stores electronically written information onto the disk. Typically, electrolessly plating a nickel phosphorus alloy layer onto the bare aluminum or aluminum alloy substrate is undertaken to protect the substrate, providing a surface which is both chemically and mechanically appropriate for subsequent processing and deposition of magnetic media. Electroless nickel alloy plating of the substrate covers defects and provides a surface which is capable of being polished and super finished.

For memory disk plating applications, electroless nickel alloy plating is an established plating method which provides continuous deposition of a nickel phosphorus (NiP) alloy coating onto the memory disk substrate without the need for external electric plating current. The resulting NiP alloy coating is amorphous, and remains suitably non-crystalline upon subsequent annealing. The formation of nickel alloy crystallites in the coating would prevent the surface from being polished and super-finished to the standards required by the memory disk industry. One method of monitoring if NiP alloy crystallite formation has occurred in the coating is through magnetics measurements of the deposit. While the amorphous phase of the NiP alloy is nonmagnetic, the crystalline domains are magnetic.

As magnetic media technology evolves to higher areal density storage devices, the memory disk industry requires more robust characteristics of the electroless nickel alloy layer. One of these deposit characteristics is improved thermal stability, meaning the ability of the deposit to withstand exposure to higher annealing temperatures without crystallization. This inhibition of crystallization during annealing manifests itself as a suppression of the deposit's magnetization when compared to less stable materials. One way to achieve an increase in thermal stability of a nickel phosphorus alloy is through the incorporation of a suitable third component which aids in the inhibition of crystallization at elevated temperatures.

Inclusion of tin (Sn) in alloys where at least one constituent is nickel (Ni) has been accomplished previously by arc melting of bulk constituents and quench cooling the resulting mixture. These works lend evidence that adding Sn to a Ni alloy should help improve the thermal stability of that material. However, the arc melting process is not suitable for coating memory disk substrates industrially. Decomposition reactions have also been utilized to make Ni—Sn materials, but this method cannot produce a smooth, uniform coating and, as such, is not suitable for memory disk applications. Electroplating of Sn—Ni alloys is also known, but this method cannot produce a film with the flatness required for memory disk applications.

Nickel phosphorus tin (NiPSn) alloys have been made previously using electroless plating baths. However, these electroless deposition techniques typically used alkaline-based baths which utilized a stannate source for Sn, and were unable to achieve both greater than 3% Sn and 7-12% P in the deposited alloy. Often, alkaline-based baths also contain sulfur-based stabilizers/accelerators, like thiourea, which degrade the corrosion resistance properties of the deposit and prevent that bath's use for memory disk applications. Additional methods included the use of very acidic NiPSn baths, but were not found to be suitable for memory disk applications. In one case, a highly acidic bath was used (pH=0.5) which required high levels of tin and thiourea, and did not result in co-deposition of phosphorus, producing a crystalline deposit at unsuitably low deposition rates (~0.6 μinches/minute). The crystalline nature of the deposit rendered it unsuitable for memory disk applications. In the other cases, the plating baths required a diboron ester, usually from glucoheptonic acid, or the formation of a stannate-gluconate complex in order to achieve co-deposition of tin. The plating baths in those works also required a greater amount of tin, and at pH<5 could not produce NiPSn deposits with both 3-9% Sn and 7-12% P under those conditions. In addition, some prior art plating baths utilized thiourea, which rendered the deposit unsuitable for memory disk applications.

Notwithstanding the prior art described herein, there is a need for an aqueous nickel phosphorus tin alloy electroless plating bath and process for chemically depositing that NiPSn alloy onto a memory disk substrate, wherein the deposited material is amorphous and possesses enhanced thermal stability as defined by the inhibition of crystallization and suppression of magnetization upon high temperature annealing. Though an obvious application for this type of aqueous nickel phosphorus tin alloy electroless plating bath and methodology for plating a substrate is in the memory disk industry, this bath and process could be used generally to apply a NiPSn alloy deposit to any appropriately activated material surface where a nickel alloy deposit is desired that possesses improved thermal stability.

SUMMARY OF THE INVENTION

In general, one aspect of the invention is to provide an aqueous nickel phosphorus tin alloy electroless plating bath for plating a substrate with a deposit containing 3-9% Sn and 7-12% P. In particular, the substrates here are preferably, but not limited to, aluminum substrates for memory disk applications. The plating bath is comprised of at least one source of nickel ion, a hypophosphite salt as a reducing agent, at least one chelating component, an auxiliary bath stabilizer, and at least one source of stannous ion. This plating bath also contains by-products from electroless nickel plating, such as orthophosphite, and any acidic or basic components used to adjust pH, or replenish the bath with reactants during plating.

One aspect of the invention is the introduction of tin into the electroless plating bath in such a way that the metal is co-deposited to form a nickel phosphorus tin alloy. In particular, the form of tin introduced here is from a stannous source.

Another object of the invention is to provide an aqueous nickel phosphorus tin alloy electroless plating bath for plating a substrate. The plating bath includes at least one source of nickel ion, wherein the at least one source of nickel ion is provided in a range from about 1-15 g/L, a hypophosphite salt as a reducing agent, wherein the hypophosphite salt is provided in a range from about 10-50 g/L, at least one chelating agent, wherein the at least one chelating agent is provided in a range from about 1-65 g/L, an auxiliary bath stabilizer, wherein the stabilizer is provided in a range≤1 g/L, and at least one source of stannous ion, wherein the at least one source of stannous ion is provided in a range from about 0.001 to about 0.1 g/L, wherein the plating bath is maintained at a pH between 4-5.

Another object of the invention is the maintenance of low levels of stannous ion in the plating bath, which is co-deposited along with the NiP. The NiPSn deposit formed from this plating bath provides between 3-9% tin and 7-12% phosphorus. The tin also acts as a bath stabilizer, decreases plateout, and ensures a smooth deposit.

Another object of this invention is to provide an aqueous nickel phosphorus tin alloy electroless plating bath that is free from thio- or thiol-based stabilizers/accelerators, like thiourea.

Another aspect of the invention is to provide a method of electrolessly plating a surface of a substrate with a ternary alloy. The method includes the steps of providing a substrate to be plated, submerging the substrate into an aqueous nickel phosphorus alloy plating bath which is heated to a temperature of less than about 96° C. (about 205° F.) and maintained at a pH between 4-5, wherein the plating bath includes at least one source of nickel ion, wherein the at least source of nickel ion is provided in a range from about 1-15 g/L, a hypophosphite salt as a reducing agent, wherein the hypophosphite salt is provided in a range from about 10-50 g/L, at least one chelating agent, wherein the at least one chelating agent is provided in a range from about 1-65 g/L, an auxiliary bath stabilizer, wherein the stabilizer is provided in a range≤1 g/L, and at least one source of stannous ion, wherein the at least one source of stannous ion is provided in a range from about 0.001 to about 0.1 g/L, and plating the nickel phosphorus tin alloy onto the surface of the substrate at a rate of about 4 microinches/minute to form a plated substrate, wherein the plated substrate has a thickness of at least 40 microinches and the nickel phosphorus tin alloy includes between 3-9% tin and between 7-12% phosphorus.

The substrate used here may be an aluminum substrate, like that utilized by the memory disk industry. However, the utility of this bath and method in producing a NiPSn coating is not limited to aluminum substrates as any metal, including aluminum and steel, or nonmetal plastic substrate may be submerged in this bath under the processing conditions described herein to deposit a NiPSn alloy film, provided that substrate's surface was activated by an appropriate pretreatment process, as commonly practiced in the electroless plating industry.

Another aspect of the method of this invention is plating the NiPSn alloy at rates relevant for the memory disk industry, particularly at rates over 2.5 μin/min (3.8 μm/hr). The method of plating the substrate further comprises replenishing the components of the aqueous nickel phosphorus tin alloy electroless plating bath as they become depleted during the plating process.

Furthermore, the electroless NiPSn deposit produced by this novel bath formulation and method possesses superior thermal stability when compared to those from typical electroless NiP alloys, meaning crystallization is inhibited during high temperature annealing, and as a result, magnetization of the NiPSn deposit is suppressed.

The benefits and advantages of the invention are achieved in accordance with the composition aspects thereof by an aqueous nickel phosphorus tin alloy electroless plating bath containing at least one nickel salt, a hypophosphite salt as a reducing agent, at least one chelating component, an auxiliary bath stabilizer, and at least one source of stannous ion for plating substrates which results in an increase in thermal stability. The incorporation of tin into the nickel phosphorus alloy is integral to the improved thermal stability of the deposit.

DETAILED DESCRIPTION OF THE DRAWINGS

DETAILED DESCRIPTION OF THE INVENTION

Figure 1:
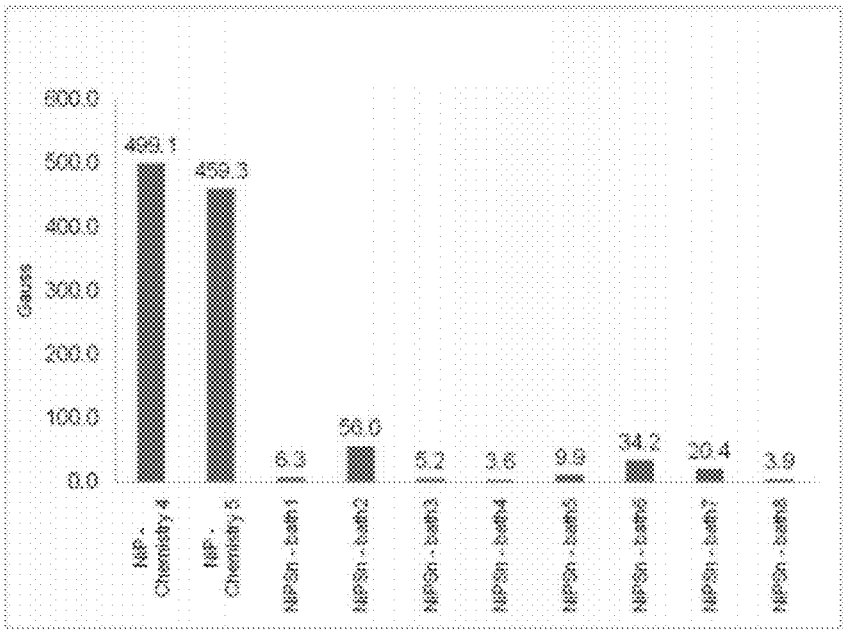
FIG. 1 is a representative graph comparing magnetic measurements of annealed deposits from aqueous nickel phosphorus tin alloy electroless plating baths according to an embodiment of the invention and from base chemistry electroless nickel plating baths not containing the source of stannous ion.

This invention relates to the development of an electroless plating bath that produces a nickel phosphorus tin alloy deposit suitable for memory disk applications. The formulation of this aqueous nickel phosphorus tin electroless plating bath referred to here is compatible with current processes used by the memory disk industry to deposit nickel underlayers. The formulation and process for depositing a NiPSn described herein may be applied to substrates other than those for memory disk applications.

One embodiment of the invention is to provide an aqueous nickel phosphorus tin alloy electroless plating bath containing at least one nickel salt, a hypophosphite salt as a reducing agent, at least one chelating component, an auxiliary bath stabilizer, and at least one source of stannous ion for plating memory disk substrates which produces an electroless nickel phosphorus tin alloy with enhanced thermal stability when compared to typical electroless nickel deposits.

Another embodiment of the invention is to provide an aqueous nickel phosphorus tin alloy electroless plating bath containing at least one nickel salt, a hypophosphite salt as a reducing agent, at least one chelating component, an auxiliary bath stabilizer, and at least one source of stannous ion for plating a suitably activated substrate surface, such as that of a metal like aluminum or steel, or a non-metal, like a plastic.

In one embodiment, the at least one nickel salt of the aqueous nickel phosphorus tin alloy electroless plating bath includes, but is not limited to, nickel salts such as nickel sulfate, nickel chloride, nickel acetate, and the like to provide a nickel ion concentration in the range from about 1 up to about 15 g/L with concentrations in the range from about 3 to about 8 g/L being preferred.

In another embodiment, the hypophosphite salt, acting as a reducing agent, will preferably be sodium hypophosphite. The concentration of hypophosphite in the plating solution is in the range from about 10 to about 50 g/L, but is preferably in the range from about 15 to about 40 g/L.

The concentration of the nickel ions and hypophosphite ions employed will vary within the aforementioned ranges depending upon the relative concentration of these two constituents in the bath, the particular operating conditions of the bath and the types and concentrations of other bath components present.

In order to provide a viable plating bath having a suitable longevity and operating performance, at least one chelating agent may be incorporated in amounts sufficient to complex the nickel ions present in the bath and to further solubilize the hypophosphite degradation products formed during usage of the bath. The complexing of the nickel ions present in the bath retards the formation of nickel orthophosphite, which is of relatively low solubility and tends to form an insoluble suspension, which not only acts as catalytic nuclei promoting bath decomposition, but also results in the formation of coarse or rough undesirable nickel deposits. In one embodiment of the invention, the at least one chelating component may include a variety of polydentate ligands such as organic acids like citric acid, lactic acid, tartaric acid, succinic acid, malic acid, maleic acid, or ethylene diamine tetraacetic acid (EDTA). In general, the total chelating component concentration should generally be in slight to moderate stoichiometric excess to the nickel ion concentration. In one embodiment, the concentration of the at least one chelating component may be provided in a range from about 1 to about 65 g/L.

In still yet another embodiment, the auxiliary bath stabilizer includes a heavy metal salt and/or an organic stabilizer. As one example, the stabilizer may be lead acetate trihydrate. The concentration of the auxiliary bath stabilizer may be ≤1 g/L.

In another embodiment, the at least one source of stannous ion may include stannous sulfate, stannous chloride, and tin methane sulfonate. The concentration of the stannous ion may be provided in a range from about 0.001 to about 0.1 g/L.

In addition to the foregoing, the composition may also contain surfactants, buffers and other similar additives. Surfactants may be added for a variety of functions including materials which assist in refining the grain of the nickel deposit. Suitable buffers, including acids, bases, or combinations thereof, may also be used in order to stabilize the pH of the plating bath.

The conditions employed in conducting the electroless plating of the nickel phosphorus tin alloy of the invention will be dependent upon the desired final concentration of the metal co-deposited with nickel in the alloy, the reducing agent employed as well as the quantity of such reducing agent desired in the alloy, and the other plating bath components described herein. Moreover the final composition of the alloy and particularly the quantity of the tin co-deposited with nickel will be a function of the pH range, concentration of the metal cation, the manner with which tin is introduced into the bath, and temperature of the bath. Accordingly, the conditions as described hereinafter may be varied and are not intended to limit the scope of the invention within the indicated ranges to achieve a variety of overall different alloy compositions.

In order to effectively plate the nickel alloy, the aqueous nickel phosphorus tin alloy electroless plating bath is heated to less than about 96° C. (about 205° F.), preferably between about 87-91° C. (about 188-196° F.). Temperatures lower than the foregoing range produce unreasonably low plating rates (less than 2 μin/min). The substrate, typically but not limited to an aluminum substrate, is then immersed in the bath for plating. Optionally, the substrate may be subjected to a suitable pretreatment process prior to plating. The pH of the plating bath may be maintained at a pH about <5, preferably between a pH of about 4-5. Further, as plating continues, the pH of the bath decreases and must be continually adjusted in order to maintain it in its optimum range with the addition of suitable buffers, including acid and/or bases. Typically, sulfuric acid, sodium hydroxide, or ammonium hydroxide is used to maintain pH. Also, on an as needed basis, the components of the aqueous nickel phosphorus tin alloy electroless plating bath may be replenished as they become depleted during the plating process.

In an embodiment of the invention, the plating of the nickel phosphorus tin alloy of the electroless plating bath yields a plating rate between 2.5 and 6 μin/min., preferably about 4 μin/min.

The composition of the nickel phosphorus tin alloy from the method of this invention maintains between 3-9% Sn and 7-12% P in the deposit. This alloy composition is typically established by thicknesses greater than 40 microinches (~1 um), and maintained at greater thicknesses. For memory disk applications, typical deposit thicknesses are between 300-600 microinches (7.5-15 μm).

In order to show the advantages of the invention, tests have been conducted of which the results are reported in the following description. These tests have taken into consideration the composition, the magnetics measurement, crystallinity, and hardness of the nickel phosphorus alloy deposits obtained with various compositions.

Thermal stability is characterized here by the ability of a material to remain amorphous after exposure to elevated temperatures. The time of the exposure depends on the temperature chosen for annealing. If a deposit is not thermally stable under the conditions chosen, all or part of the film can undergo crystallization. Amorphous Ni alloys are typically non-magnetic while crystalline Ni alloys are typically magnetic. One way to monitor the degree of crystallization of a Ni alloy is by measuring the magnetics of that material and comparing it to a reference. When subjected to the same annealing conditions, a lower magnetics measurement for a deposit when compared to that from a typical NiP alloy is an indication of improved thermal stability.

In order to compare the effectiveness of the nickel phosphorus tin alloy deposit of the present invention as a more thermally stable alternative to traditional NiP deposits, magnetics measurements were conducted on nickel deposits from commercially available electroless nickel plating baths. A memory disk aluminum substrate was subjected to a pretreatment process to activate its surface and then submerged into a commercially available electroless nickel bath which was heated to between about 87-91° C. (about 188-196° F.) and maintained at a pH between 4-5. The components of the electroless plating bath were replenished as they became depleted during plating. Thermal stability was tested by placing the coated memory disk substrate into an oven for 15 minutes at a temperature of about 350° C. (about 660° F.), and then measuring magnetics of that sample using a Lake Shore Vibrating Sample Magnetometer (VSM) with a cycling field of ±5000 Oe. Magnetization contribution from the aluminum substrate is subtracted and the saturation magnetization of the deposit is reported as Gauss.

The results from the testing of the nickel deposits from the commercially available electroless nickel plating baths are shown in Table 1.

TABLE 1

| Deposit from Commercialized Chemistry Samples | thickness (u") | T (C.) | time (min) | Mag (G) |
|---|---|---|---|---|
| Chemistry 1 | 486 | 350 | 15 | 385 |
| Chemistry 2 | 382 | 350 | 15 | 329 |
| Chemistry 3 | 521 | 350 | 15 | 487 |

As seen from the magnetic measurements of Table 1, each of the deposits from commercially available electroless nickel alloy plating baths are well above 100 Gauss after the minute annealing time at a temperature of about 350° C.

For comparison purposes, magnetics measurements were then conducted on nickel phosphorus tin alloy deposits from baths that include the source of stannous ion according to the aqueous nickel phosphorus tin alloy electroless plating bath and method of the present invention. In particular, tin methane sulfonate was added to a base electroless nickel alloy plating bath in such a way that tin was co-deposited. A memory disk aluminum substrate was subjected to a pretreatment process to activate its surface and then submerged into the aqueous nickel phosphorus tin alloy electroless plating bath of the present invention which was heated to between about 87-91° C. (about 188-196° F.) and maintained at a pH between 4-5. The components of the aqueous nickel phosphorus tin alloy electroless plating bath were replenished as they became depleted during plating until about 400 microinches of the nickel phosphorus tin alloy was deposited on the surface of the substrate. In one example, the composition of the aqueous nickel phosphorus tin alloy electroless plating bath included the following components:

| | |
|---|---|
| Nickel ion | 3-8 g/L |
| Auxiliary bath stabilizer | 0-1 g/L |
| Hypophosphite salt | 15-40 g/L |
| Tin ion (from stannous source) | 0.001-0.1 g/L |
| Chelating Component(s) | 1-65 g/L |

Magnetics measurements for the NiPSn alloy deposits were taken after a 15 minute annealing time at about 350° C. in the same way as for samples from the commercialized chemistries in Table 1. As seen in FIG. 1, the magnetics measurements after annealing the nickel phosphorus tin deposits from the aqueous nickel phosphorus tin alloy electroless plating bath of the present invention are each less than 100 Gauss, and in most cases less than 10 Gauss. The nickel phosphorus tin alloy deposits are less magnetic after annealing when compared to deposits from the base chemistry plating bath not containing the source of stannous ion and annealed under the same conditions, indicating that the inclusion of tin has resulted in a more thermally stable deposit.

Figure 2:
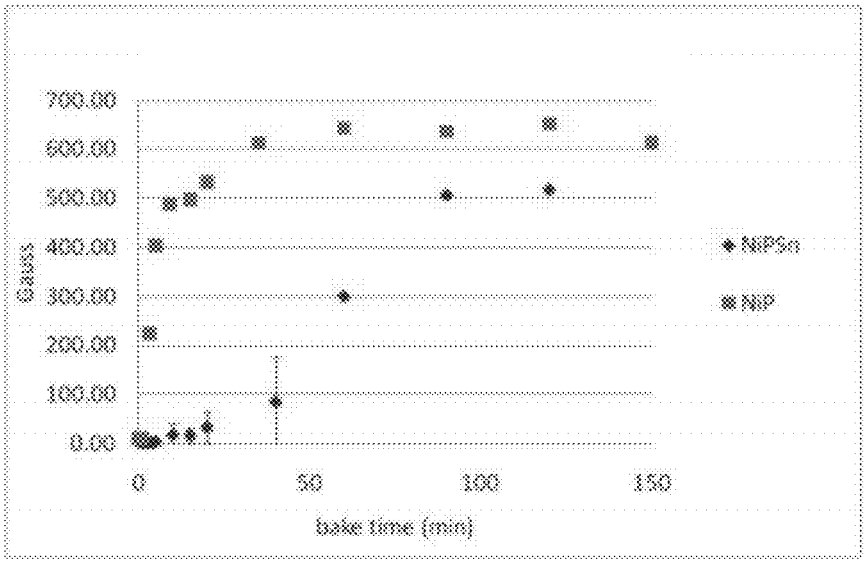
FIG. 2 shows magnetization as a function of time at 350° C. for NiPSn and NiP.

The improved thermal stability of the NiPSn deposit from this invention compared to a NiP deposit can also be observed by measuring magnetics as a function of time and comparing the rate at which magnetization (from crystallization) increases. As seen in FIG. 2, the NiPSn alloy increases in magnetization at a slower rate than a NiP alloy when held at 350° C. (about 660° F.), indicating that crystallization is inhibited in the NiPSn deposit.

Figure 3:
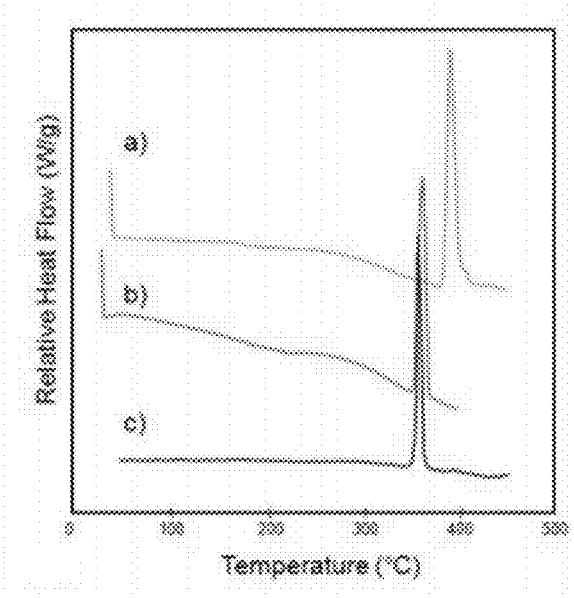
FIG. 3 shows representative Differential Scanning calorimetry (DSC) traces comparing the crystallization temperature of a) a typical NiPSn deposit with b) and c) typical NiP deposits.

Another indicator of improved thermal stability is the ability of a material to remain amorphous at higher temperatures. Inhibition of crystallization would manifest itself as an increase in the crystallization temperature of an amorphous material. An additional test of thermal stability is a measurement of the crystallization temperature ($T_c$) for the amorphous material using differential scanning calorimetry (DSC). The results are shown in FIG. 3. For comparison, DSC scans were taken for a NiPSn deposit of the present invention and typical NiP deposits on a DSC Q2000 (TA Instruments) under an $N_2$ gas purge from ambient to elevated temperature at a ramp rate of 10° C./minute. The measured crystallization temperatures using this technique are as follows: a) NiPSn, $T_c$=393.42° C.; b) Commercial Bath 1 NiP, $T_c$=364.45° C.; and c) Commercial Bath 2 NiP, $T_c$=359.33° C. As seen in FIG. 3, the crystallization temperature of the NiPSn deposit (a), produced in accordance with the bath and method laid out in this invention, is about 30° C. higher than that of NiP deposits from typical electroless nickel alloy baths (b and c), indicating that the addition of Sn to the alloy inhibits crystallization until higher temperatures, and demonstrating that the NiPSn alloy is more thermally stable.

Figure 4:
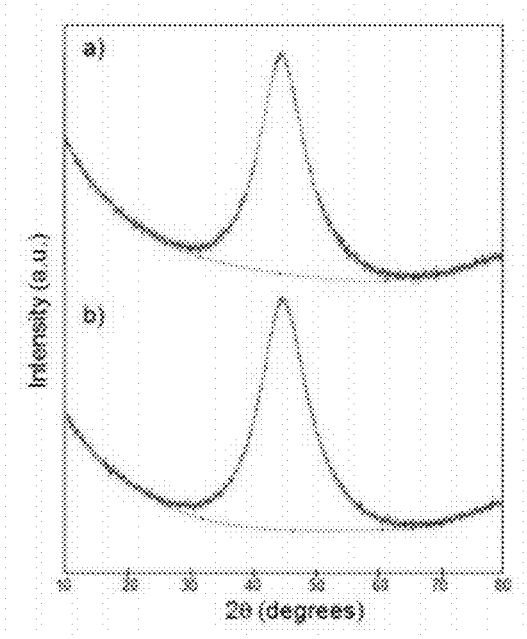
FIG. 4 shows representative X-Ray Diffraction (XRD) data comparing the crystallinity of a) a typical as-plated NiPSn deposit with b) an as-plated NiP deposit.

The addition of an alloying element can result in phase changes. It is important to control the level of tin co-deposited in the NiPSn alloy to prevent segregation of Ni-rich and Sn-rich domains. FIG. 4 shows x-ray diffractograms illustrating that the electrolessly deposited NiPSn (a) from an embodiment of this invention is amorphous, indicated by the observance of a broad peak in the diffractogram, much like typical electrolessly deposited NiP (b).

Energy dispersive x-ray spectroscopy (EDX) measurements were then conducted utilizing on an FEI Quanta 200 2D SEM. As seen in Table 2, the NiPSn samples were measured to contain both % Sn=3-9% and % P=7-12%.

TABLE 2

| Sample | % Ni | % P | % Sn |
|---|---|---|---|
| Chemistry 3 | 87.9 | 12.1 | — |
| Chemistry 3 modified for Sn formulation - test 1 | 84.8 | 11.0 | 4.2 |
| Chemistry 3 modified for Sn formulation - test 2 | 83.2 | 10.3 | 6.5 |

The improvement of thermal stability of the material should be achieved without negative impact on other desirable properties of an electroless nickel alloy coating, such as hardness or corrosion resistance.

The hardness of the electrolessly deposited NiPSn film from this invention should be mechanically comparable to that of a typical NiP film. Hardness measurements were made on electrolessly coated aluminum substrates with a Buehler Micromet 2100 using 0.01 kgf and presented in Vickers Hardness Number (VHN). As shown in Table 3, hardness measurements of nickel phosphorus tin alloy deposits according to an embodiment of the invention are similar to that measured for a commercially available electroless nickel alloy deposit.

TABLE 3

| Sample | Hardness (VHN) |
|---|---|
| Chemistry 3 | 613 |
| Chemistry 3 modified for Sn formulation - test 1 | 613 |
| Chemistry 3 modified for Sn formulation - test 2 | 625 |

Corrosion resistance may be defined by mass loss of the deposit upon exposure to a corrosive environment. The corrosion resistance of the nickel phosphorus tin alloy deposit according to an embodiment of the invention is characterized using a mass loss technique. After exposure to 50/50% vol. nitric acid for about 20 minutes, x-ray florescence (XRF) measurements were conducted using a Thermonoran LXHR to determine the change in thickness of the deposit. The results of this analysis, as seen in Table 4, showed that the nickel phosphorus tin alloy deposit according to an embodiment of the invention was more corrosion resistant than resulting nickel deposits from commercially available nickel plating baths, as evidenced by the smaller thickness loss of that sample.

TABLE 4

| Sample | ΔThickness (μ") |
|---|---|
| Chemistry 4 | 47.8 |
| Chemistry 4 modified for Sn formulation | 17.5 |

Based upon the foregoing disclosure, it should now be apparent that the aqueous nickel phosphorus tin alloy electroless plating bath and the process for depositing this nickel alloy onto a substrate as described herein will carry out the objects set forth hereinabove. It is, therefore, to be understood that any variations evident fall within the scope of the claimed invention and thus, the selection of specific component elements can be determined without departing from the spirit of the invention herein disclosed and described.

What is claimed is:

1. An aqueous nickel phosphorus tin alloy electroless plating bath for plating a substrate, the plating bath comprising:

at least one source of nickel ion, wherein the at least one source of nickel ion is provided in a range from about 1-15 g/L;

a hypophosphite salt as a reducing agent, wherein the hypophosphite salt is provided in a range from about 10-50 g/L;

at least one chelating agent, wherein the at least one chelating agent is provided in a range from about 1-65 g/L;

an auxiliary bath stabilizer, wherein the stabilizer is provided in a range≤1 g/L; and at least one source of stannous ion which comprises tin methane sulfonate, wherein the at least one source of stannous ion is provided in a range from about 0.001 to about 0.1 g/L, wherein the plating bath is maintained at a pH between 4-5.

2. The bath of claim 1, wherein the at least one source of nickel ion is selected from the group consisting of nickel sulfate, nickel chloride, and nickel acetate.

3. The bath of claim 1, wherein the at least one source of nickel ion is provided in a range from about 3-8 g/L.

4. The bath of claim 1, wherein the hypophosphite salt is sodium hypophosphite.

5. The bath of claim 1, wherein the hypophosphite salt is provided in a range from about 15-40 g/L.

6. The bath of claim 1, wherein the at least one chelating agent may be selected from the group consisting of citric acid, lactic acid, tartaric acid, succinic acid, malic acid, maleic acid, and ethylene diamine tetraacetic acid.

7. The bath of claim 1, wherein auxiliary bath stabilizer is lead acetate trihydrate.

8. The bath of claim 1, wherein the aqueous nickel phosphorus tin alloy electroless plating bath is free of sulfur-based accelerators and stabilizers.

9. The bath of claim 1, wherein the aqueous nickel phosphorus tin alloy electroless plating bath is free of components selected from the group consisting of diboron esters, boro-gluconic acid complexes, and stannate-gluconate complexes.

10. The bath of claim 1, wherein the substrate is a material selected from the group consisting of steel, aluminum, thermoplastic polymers, and thermoset polymers.

* * * * *